US008231026B2

(12) United States Patent
White

(10) Patent No.: US 8,231,026 B2
(45) Date of Patent: Jul. 31, 2012

(54) CONDIMENT CONTAINER

(76) Inventor: Scott Alan White, Homewood, IL (US)

( * ) Notice: Subject to any disclaimer, the term of this patent is extended or adjusted under 35 U.S.C. 154(b) by 777 days.

(21) Appl. No.: 11/255,367

(22) Filed: Oct. 21, 2005

(65) Prior Publication Data

US 2007/0090107 A1 Apr. 26, 2007

(51) Int. Cl.

| | |
|---|---|
| ***B65D 21/02*** | (2006.01) |
| ***B65D 51/20*** | (2006.01) |
| ***B65D 17/34*** | (2006.01) |
| ***B65D 41/00*** | (2006.01) |

(52) U.S. Cl. ..... 220/359.2; 220/23.87; 220/23.88; 220/23.89; 220/258.1; 220/258.2; 220/359.1

(58) Field of Classification Search ..... 220/23.87, 220/23, 88, 23.89, 258.1, 258.2, 359.2, 359.3, 220/23.88

See application file for complete search history.

(56) References Cited

U.S. PATENT DOCUMENTS

| | | | | |
|---|---|---|---|---|
| 2,705,579 | A * | 4/1955 | Mason | 222/107 |
| 2,898,003 | A * | 8/1959 | Wilson et al. | 222/107 |
| 3,101,870 | A * | 8/1963 | Betner | 222/153.07 |
| 3,743,520 | A | 7/1973 | Croner | |
| 4,264,007 | A | 4/1981 | Hunt | |
| 4,301,926 | A * | 11/1981 | Chung | 229/103.1 |
| 4,648,506 | A * | 3/1987 | Campbell | 206/216 |
| 4,762,241 | A * | 8/1988 | Lang | 215/250 |
| 5,341,969 | A * | 8/1994 | Accardo et al. | 222/465.1 |
| D357,863 | S | 5/1995 | Picozza | |
| 5,624,052 | A * | 4/1997 | Caldi | 220/575 |
| 5,676,340 | A * | 10/1997 | Ruhnau | 248/311.2 |
| 5,722,558 | A | 3/1998 | Thompson | |
| 5,878,904 | A * | 3/1999 | Schweigert | 220/23.88 |
| 5,897,041 | A * | 4/1999 | Ney et al. | 224/483 |
| 6,003,673 | A | 12/1999 | Vieu | |
| 6,070,791 | A * | 6/2000 | Correll | 229/120.01 |
| 6,131,804 | A * | 10/2000 | Julian | 229/125.09 |
| 6,250,346 | B1 | 6/2001 | Castillo | |
| 6,263,923 | B1 | 7/2001 | Castillo | |
| 6,315,153 | B1 * | 11/2001 | Osborn | 220/737 |
| 6,363,978 | B2 | 4/2002 | Castillo | |
| 6,412,526 | B2 | 7/2002 | Castillo | |
| 6,708,735 | B1 | 3/2004 | Kenihan | |
| 7,703,619 | B2 | 4/2010 | Van Puijenbroek | |
| 2001/0032791 | A1 * | 10/2001 | Hudson | 206/217 |
| 2003/0019871 | A1 | 1/2003 | Nance | |
| 2004/0050847 | A1 | 3/2004 | Yoon | |
| 2004/0182862 | A1 | 9/2004 | Scott | |

FOREIGN PATENT DOCUMENTS

WO 2004063048 A1 7/2004

* cited by examiner

*Primary Examiner* — Anthony Stashick
*Assistant Examiner* — Andrew T Kirsch
(74) *Attorney, Agent, or Firm* — Polsinelli Shughart PC; Brian Diekhoff

(57) ABSTRACT

A condiment container whose form factor of the condiment container is selected to enable the condiment container to be carried and held in place by a standard drink holder. By configuring the condiment container to be received in a standard drink holder, the problems associated with incorporating a condiment container in a drink container lid are overcome.

19 Claims, 6 Drawing Sheets

20
Long Axis
32
24
28
22

20
Short Axis
34
22

32
20
30

30
32
26
33

34
42
44
40
46
38

34
48

34

30
26
33

26
33

50
56
60
52
58

30

CONDIMENT CONTAINER

BACKGROUND OF THE INVENTION

1. Field of the Invention

The present invention relates to a condiment container and more particularly to a condiment container configured to be carried by a standard drink holder to enable condiments to be securely carried in place in a vehicle during travel.

2. Description of the Prior Art

In today's society, due to time constraints, many people are known to purchase fast food, as well as soft drinks, for consumption while traveling. Consumption of soft drinks, such as soda and coffee, is so commonplace that virtually all vehicles include drink holders for holding such drinks during travel. However, it is difficult, if not impossible for travelers to enjoy condiments with finger food items, such as french-fries and chicken strips, for example. In particular, some condiments, such as ketchup, are normally provided in a pillow-type condiment container that is adapted to be opened at one end. Such a condiment container makes it virtually impossible for a driver to enjoy ketchup with french-fries. In addition, chicken strips and other fast-food finger items are known to include special sauces, which are normally supplied in tub type containers which need to carried in a stable manner to prevent spillage. Unfortunately, it is virtually impossible to carry such containers in a stable manner unless the driver holds the container with one hand. Inasmuch as drivers need to maintain one hand on the wheel, only one hand is free for grasping the fast-food finger item. If a driver wishes to use a condiment while driving, the driver must attempt to open the condiment container before driving and place the open condiment container on the vehicle seat. However, such condiment containers are likely to tip and spill on the seat.

In order to solve this problem, various solutions have been proposed. In general, these solutions relate to providing a lid for a soft drink which includes a compartment for receiving a condiment. Examples of such container lids are disclosed in U.S. Pat. No. 5,722,558 as well as U.S. Patent Application Publication Nos. U.S. 2004/0050847 A1 and U.S. 2004/0182862 A1, hereby incorporated by reference. In general, such drink lids include a compartment for receiving a condiment. In particular, the '588 patent discloses a container lid for use with a hot or cold soft drink. The container lid is formed with a well which extends downwardly into the drink container. The well is adapted to receive a condiment.

There are several problems with such a configuration. First, since the well extends down into the drink container, the condiment will either be heated or cooled depending on the temperature of the liquid in the drink container. Secondly, if the drink container is tilted for consumption, the tilting could possibly cause the condiment in the well in the container lid to spill or leak into the drink itself or vice versa.

In order to solve this problem U.S. Patent Application Publication No. U.S. 2004/0182862 A1 discloses an alternate disposable container lid in which the condiment container is formed in a container lid that is configured so that the condiment reservoir does not extend into the drink container. In order to further insulate the condiment in the reservoir from the heating or cooling effects of the soft drink within the drink container, a bottom floor of the reservoir is formed with a thermal insulating layer.

Although this container lid solves the problems mentioned above, there are other problems associated with such a drink container. First, the drink container only includes a single condiment reservoir. As such, multiple condiments can not be accommodated. In addition, the condiment reservoir is only adapted to be utilized with soft drinks which are consumed via a straw, such as soda. Other soft drinks, such as coffee and hot chocolate, are not suitable for use with the configuration disclosed in the above mentioned U.S. Patent Application Publication for the reasons discussed above. Finally, the soft drink lid is a custom lid is more expensive than conventional lids. Fast food suppliers would thus be confronted with the problem of ascertaining whether customers require lid dispensers or container lids with condiment reservoir or supplying all customers with the more expensive drink container lids with the built in condiment reservoirs.

U.S. Patent Application Publication No. U.S. 2004/0050847 A1 also discloses a container lid for a soft drink with an integrated compartment for condiment. This published application is configured with a recessed compartment for receiving a separate condiment container. Similar to the container lid discussed above, the container lid disclosed in the '847 publication is only suitable for use with cold soft drinks that are normally consumed through a straw. Thus, there is a need for a condiment holder for use in a vehicle which avoids the problems associated with the prior art.

SUMMARY OF THE INVENTION

The present invention relates to a condiment container that is configured to be carried by a conventional drink holder, standard on just about all vehicles. In accordance with an important aspect of the invention, the condiment container is formed with a form factor selected to enable the condiment container to be carried in place by a standard drink holder. By configuring the condiment container to be carried by a standard drink holder, the problems associated with incorporating a condiment container in a drink container lid are overcome. The container can be configured with various design options which lend to multiple applications of the container.

DESCRIPTION OF THE DRAWINGS

These and other advantages of the present invention will be readily understood by reference to the following specification and attached drawing wherein.

DETAILED DESCRIPTION

The present invention relates to a condiment container for carrying various condiments for various fast food items. In accordance with an important aspect of the invention, the condiment container is configured to be carried by a standard drink holder. As such, fast foods consumed during travel can be enjoyed with condiments that are relatively securely carried in a standard drink holder.

Various configurations of the condiment container are contemplated. In accordance with an important aspect of the invention, the condiment container is formed with a container portion having a dimension slightly less than the interior diameter of a standard drink container. In order to enable the condiment container to be carried at the top of the drink container, the condiment container also includes one or more outwardly extending lips. The lips are configured to rest on the mouth of the drink holder so that the top plane of the condiment container is generally flush with the top of the drink holder. As such, the condiment container facilitates the use of condiments for fast foods that are consumed during travel.

Figures 1A, 1B, 1C, 1D:
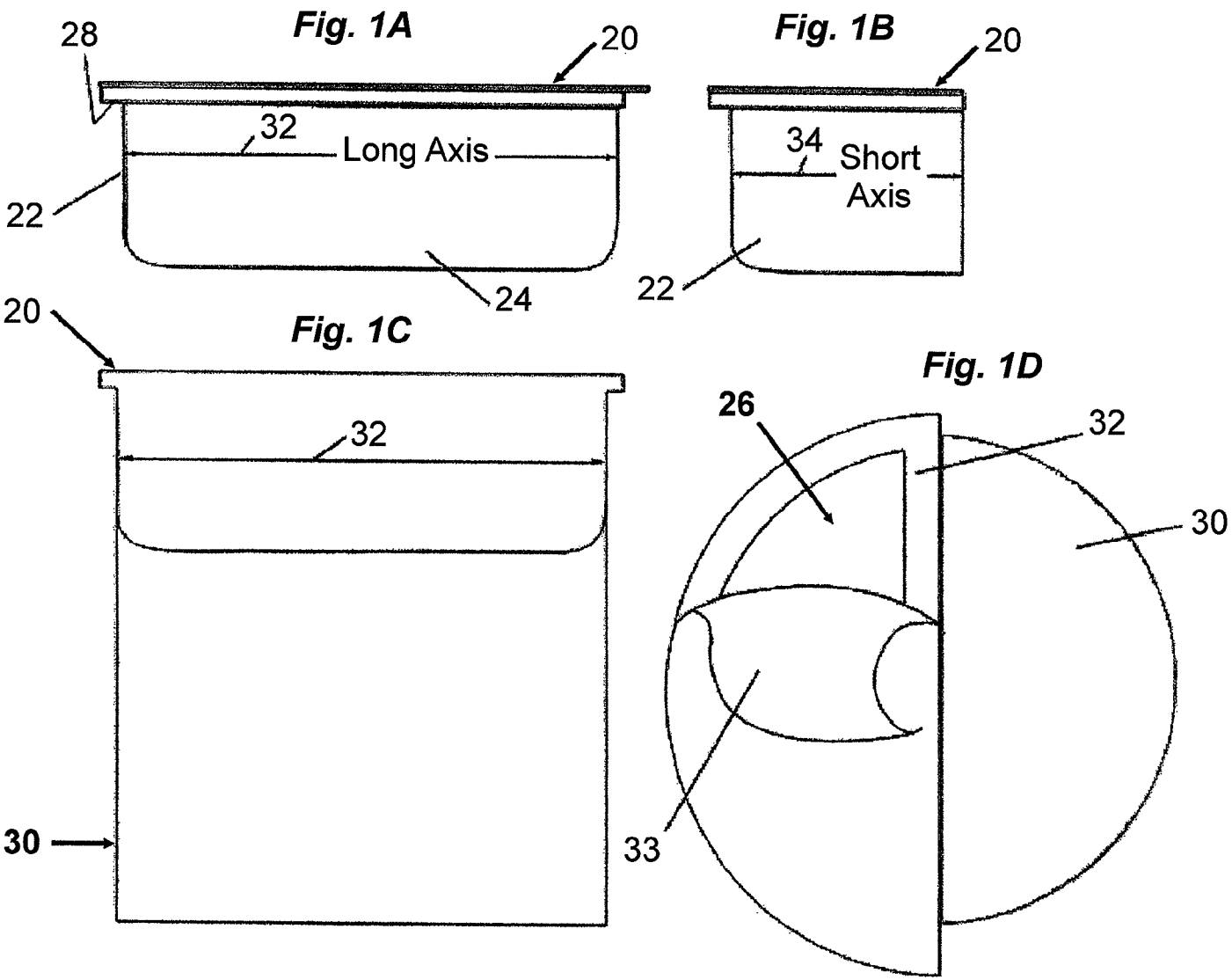
FIG. 1A is a side elevational view of one embodiment of the condiment container in accordance with the present invention.
FIG. 1B is a front elevational view of the condiment container illustrated in FIG. 1A.
FIG. 1C is a side elevational view illustrating the condiment container illustrated in FIG. 1A disposed in a standard cup holder.
FIG. 1D is a top view of a condiment container in accordance with the present invention being carried in a standard cup holder, illustrated with a portion of the removable cover removed.

FIGS. 1A and 1B illustrate a first embodiment of the invention. As shown in FIGS. 1A, 1B and 1D, the condiment container, generally identified with the reference numeral 20, is formed with an annular sidewall 22 forming a generally cylindrical container portion. The container portion 22 is closed at one end defining a generally linear bottom floor 24. An opposing end 26 is open and formed with a peripheral shoulder 28. The shoulder 28 extends radially outwardly from the container portion 22 and is configured to enable the condiment container 20 to be supported on an open mouth 30 of a standard or non-standard drink holder.

The length along the longest edge or portion 32 of the condiment container is selected to be less than the interior diameter of the drink holder 30. This length plus the width of the shoulder 28 is selected so that the shoulder 28 rests on the mouth 30 of a standard drink holder. Various dimensions of the shoulder 28 are contemplated. For example, a ¼ an inch shoulder may be used contemplated. Virtually any size can be used which allows the shoulder 28 to rest on the mouth of the cup holder 30.

Figure 4A:
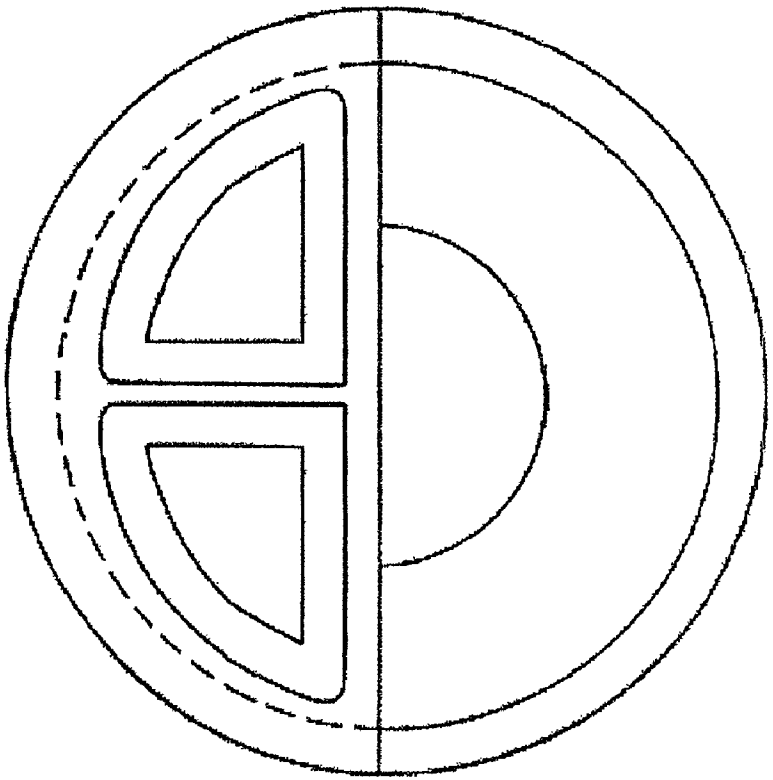
FIG. 4A is a top view of an alternate embodiment of the invention illustrating a condiment container with two compartments.
Figure 4B:
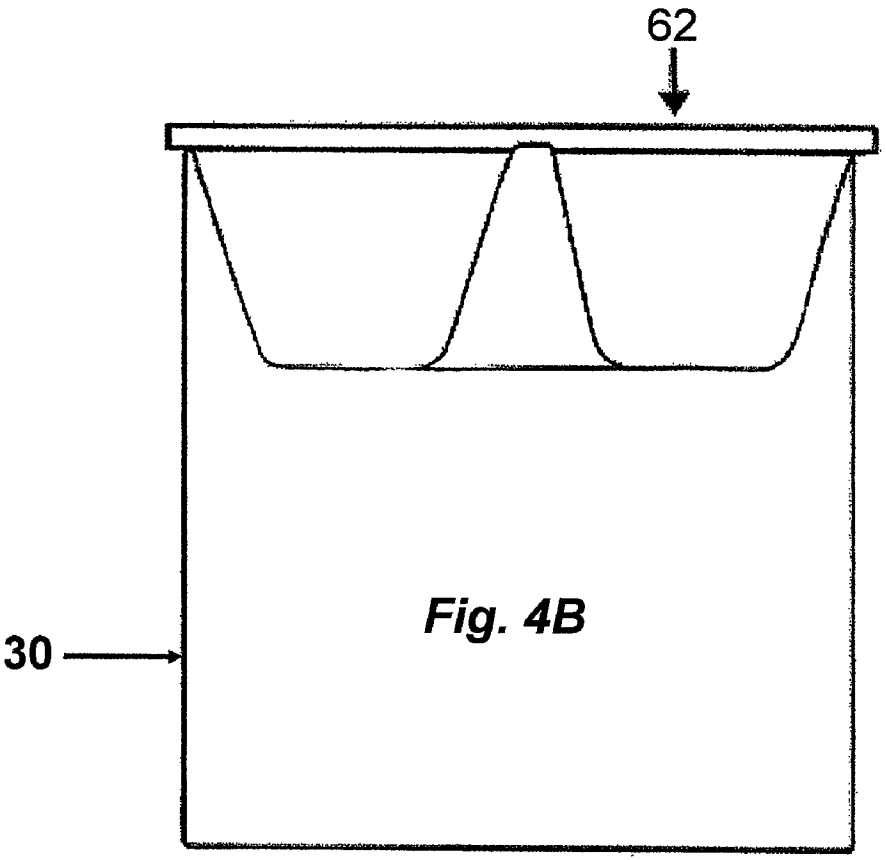
FIG. 4B is a side view of the condiment container illustrated in FIG. 4A, shown being carried in a standard drink holder.
Figure 5A:
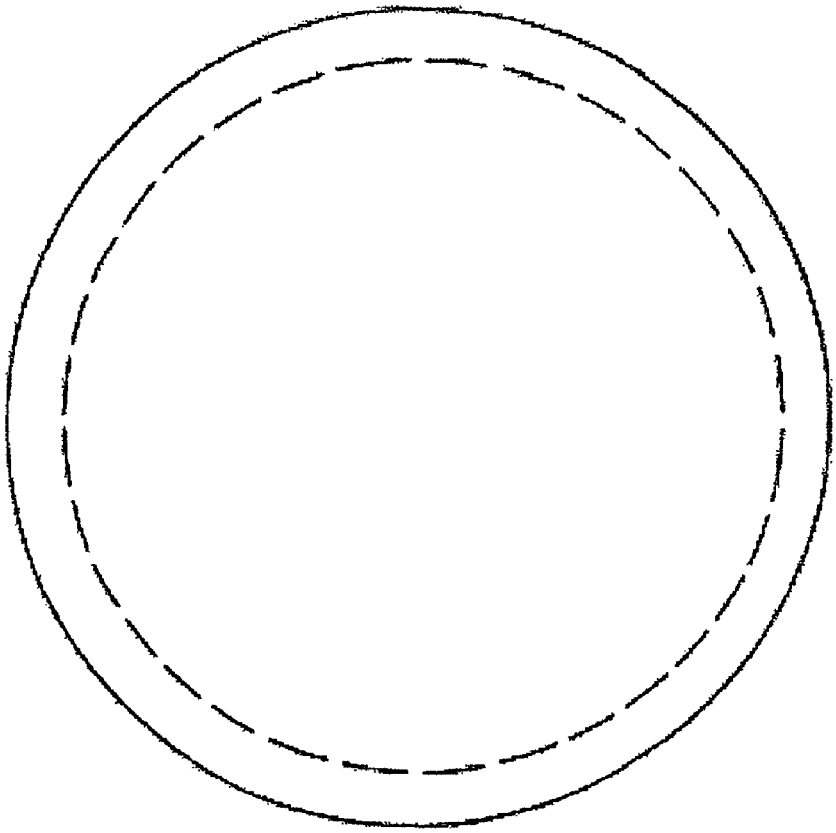
FIG. 5A is a top view of another alternate embodiment of the condiment container in accordance with the present invention.
Figure 5B:
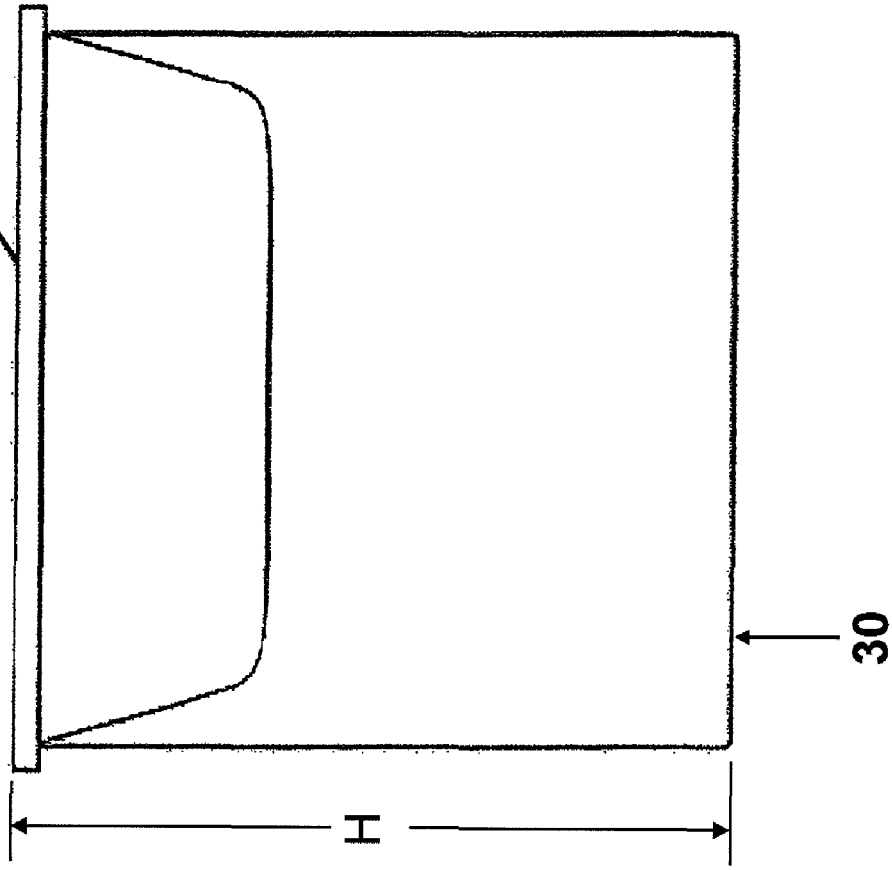
FIG. 5B is a side view of the condiment container illustrated in FIG. 5A, shown being carried in a standard drink holder.
Figure 6A:
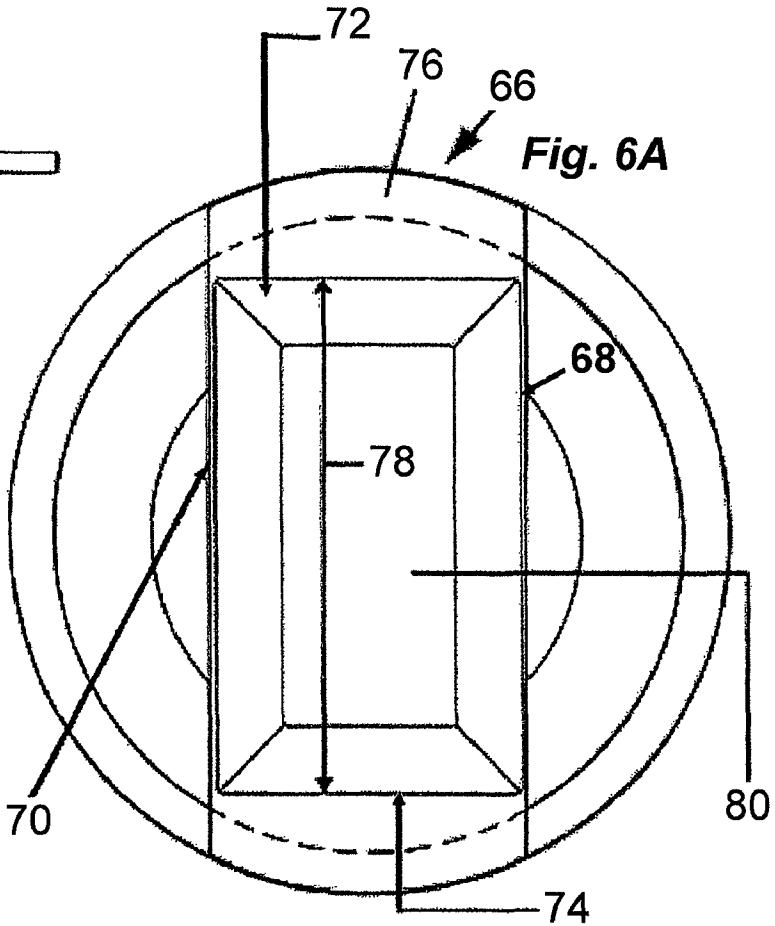
FIG. 6A is a top view of another alternate embodiment of the condiment container in accordance with the present invention.
Figure 6B:
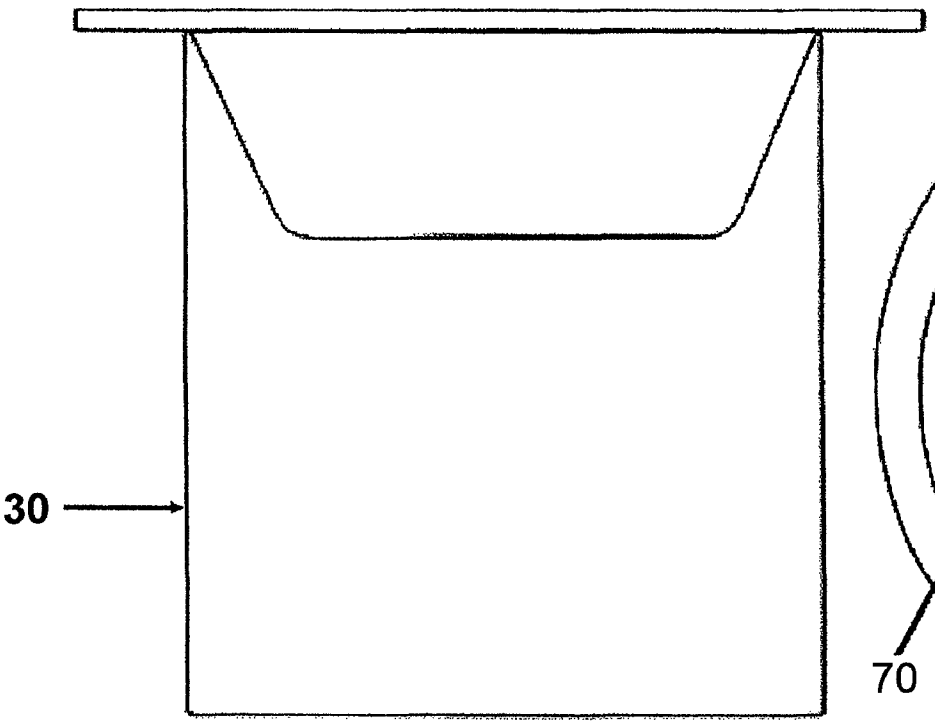
FIG. 6B is a side view of the condiment container illustrated in FIG. 6A, shown being carried in a standard drink holder.

The container can be configured in various shapes and formed from a material, suitable for use in the food industry and molded. For example, the condiment container can be configured to be a generally cylindrical container, for example, with a single compartment, such that only one condiment container fits within a standard drink holder, as generally shown in FIGS. 5A and 5B. Moreover, the height H (FIG. 5B) can be varied depending on the amount of condiment to be dispensed. In other embodiments, the condiment container may be configured in a generally semi-circular shape, for example, as shown in FIGS. 1A-4B. As shown in FIGS. 4A and 4B, the condiment container may be formed with multiple compartments. FIGS. 6A and 6B illustrate another embodiment which has a generally non-circular shape.

Figures 2A, 2B, 2C, 2D:
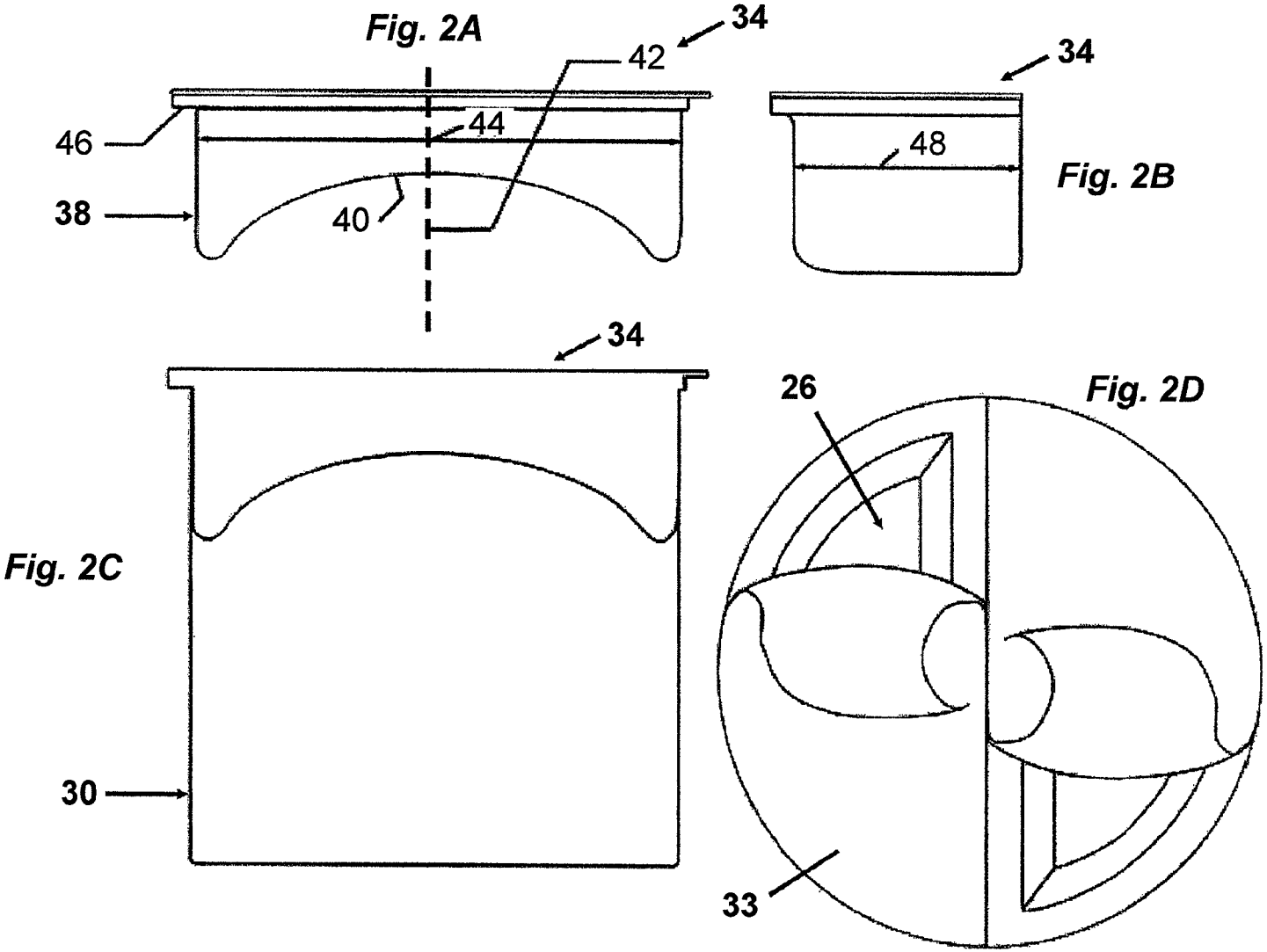
FIG. 2A is a side elevational view of a alternate embodiment of the condiment container illustrated in FIG. 1A.
FIG. 2B is a front elevational view of the condiment container illustrated in FIG. 2A.
FIG. 2C is a side elevational view of the condiment container illustrated in FIG. 2A being carried by a standard drink holder.
FIG. 2D is a top view of two condiment containers in accordance with the present invention being carried in a standard drink holder at the same time, each illustrated with a portion of its removable cover removed.
Figure 3B:
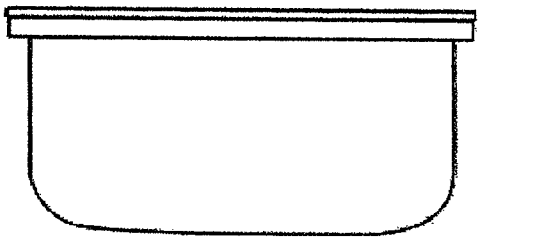
FIG. 3B is a front elevational view of the condiment container illustrated in FIG. 3A.
Figure 3D:
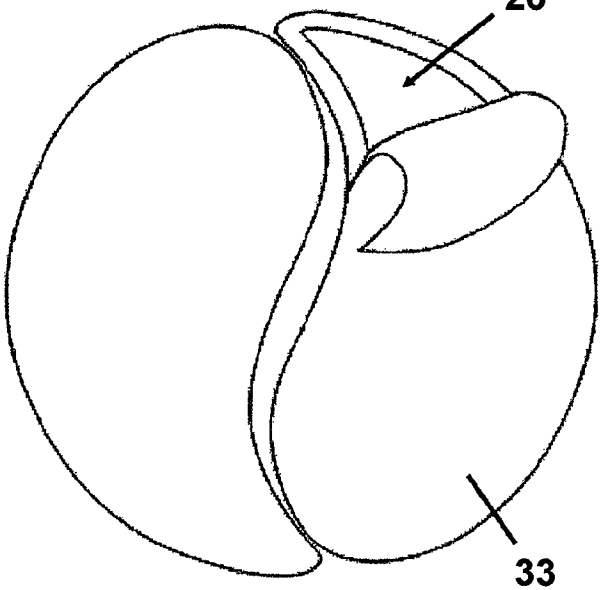
FIG. 3D is a top view illustrating two condiment containers as illustrated in FIG. 3A being carried by a standard drink holder at the same time, shown with the removable cover of one condiment container totally removed and the other condiment container with the removable cover partially removed.
Figure 3A:
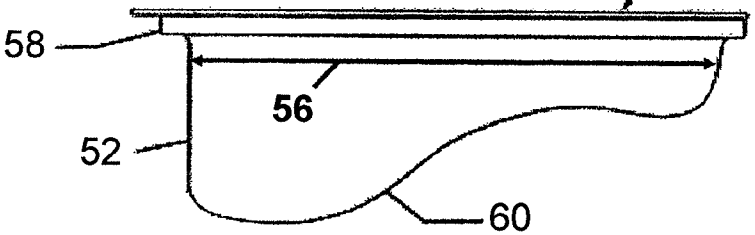
FIG. 3A is a side elevational view of another alternate embodiment of the condiment container illustrated in FIG. 1A.
Figure 3C:
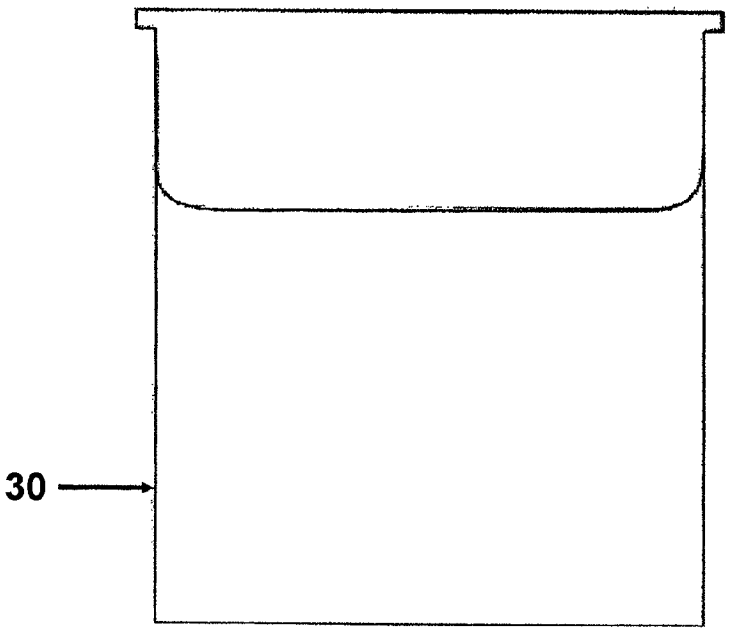
FIG. 3C is a side elevational view of the condiment container illustrated in FIG. 3A being carried by a standard cup holder.

In general, the condiment containers in accordance with the present invention include removal covers, generally identified with the reference numeral 33 (FIG. 1D), for closing the open end 26, for example as shown in FIGS. 1D, 2D and 3D. These covers 33 are formed from a material suitable for use with the food industry. The covers 33 are attached to a top portion of the lip 28 with an adhesive also suitable for use in the food industry.

FIGS. 2A, 2B, 2C and 2D illustrate an alternate embodiment of the condiment container, generally identified with the reference numeral 34. The container 34 is formed with an irregular shape as best shown in FIG. 2A and includes an annular sidewall 38 forming a container portion and an irregular shaped floor 40, as best shown in FIG. 2A. The container portion 38 is formed with a generally semi-circular shape, as best shown in FIG. 2D, and also formed to be symmetrical relative to a vertical axis 42. In particular, the container portion 38 is configured such that a short axis 48 (FIG. 2B) is selected to allow two condiment containers to be carried at the same time in a single drink holder. The curved floor or bottom 40 allows a consumer to balance the container 34 on one leg.

FIGS. 3A, 3B, 3C and 3D, illustrate a condiment, generally identified with the reference number 50, formed with a slightly irregular but generally semi-circular shape, as best shown in FIG. 3D. Similar to the other embodiments illustrated in FIGS. 1A and 2A, the container 50 is formed with an annular sidewall forming a container portion 52 defining a long axis 56 and a bottom floor 60, slightly less than the interior diameter of a standard drink holder. A peripheral shoulder 58 is formed adjacent an open portion of the container portion 52. As shown best in FIGS. 3A and 3C, the bottom floor 60 may be formed with an irregular shape. As best shown in FIG. 3D, the configuration of the container 50 allows a product to be dipped from wide and deep end, or squirted from narrow end when the cover is removed.

FIGS. 4A and 4B illustrate another alternate embodiment, generally identified with the reference numeral 62. As illustrated, this embodiment is similar to the embodiment illustrated in FIG. 1A-1D, except the condiment container 62 is formed with more than one compartment.

FIGS. 5A and 5B illustrate another alternate embodiment, generally, identified with the reference numeral 64. This embodiment is similar to the embodiment illustrated in FIGS. 1A-1D, except the container 64 is configured in a generally circular shape so that only one container generally fits within a standard drink holder. As shown, the condiment container includes a single compartment. However, the container 64 can be configured with multiple compartments as discussed above.

FIGS. 6A and 6B illustrate an embodiment, generally identified with the reference numeral 66. The condiment container 66 is formed with two spaced apart linear sides 68, 70. The spaced apart sides 68, 70 need not be linear but can be virtually any shape. The other two sides 72 and 74 may be formed to be linear or virtually any shape. A pair of lips 76 is formed to extend outwardly from the sides 72, 74. It is only important that a major axis 78 (FIG. 6A) of the container 66 be selected to be less than the interior diameter of the standard drink holder plus the width of the lips 76 is selected so that they extend over the mouth of the standard drink holder. A cover 80 is also provided. The cover 80 is not removable but may include access to the interior of the container.

Obviously, many modifications and variations of the present invention are possible in light of the above teachings. Thus, it is to be understood that, within the scope of the appended claims, the invention may be practiced otherwise than as specifically described above.

What is claimed and desired to be secured by a Letters Patent of the United States is:

1. A condiment container for carrying various condiments, the condiment container comprising:

a container formed with a continuous sidewall with varying heights and forming a predetermined shape closed on one end forming a bottom floor and open on an opposing end defining an open end forming a container portion for receiving a condiment, said container portion formed with a form factor that enables said container to be received in a standard vehicle drink holder by way of a shoulder portion, said bottom floor formed to provide a deep end of said condiment container and a shallow end of said condiment container;

said shoulder portion comprising one or more extending shoulders extending outwardly from said continuous sidewall adjacent said open end configured to vertically support said container portion in said standard vehicle drink holder; and a cover for covering said open end of said container portion, the cover attached to the open end of said container by an adhesive, the cover is peelable from the deep end of the container, the cover is totally removable from the deep end of the container to access the deep end of the container, and the cover is removable from the shallow end of the container to squirt the condiment from the shallow end of the container.

2. A condiment container as recited in claim 1, wherein said container portion is configured with a single compartment.

3. A condiment container as recited in claim 1, wherein said container portion is configured with more than one compartment.

4. A condiment container as recited in claim 3, wherein said container portion is configured with two compartments.

5. The condiment container as recited in claim 1, wherein said cover is secured to said container portion with the adhesive.

6. The condiment container as recited in claim 1, wherein said container portion is configured in a generally cylindrical shape.

7. The condiment container as recited in claim 1, wherein said container portion is configured in a generally circular shape.

8. The condiment container as recited in claim 1, wherein said container portion is configured in a generally semi-circular shape.

9. The condiment container as recited in claim 1, wherein said container portion is configured in a generally semi-circular shape having two spaced apart generally linear sides.

10. The condiment container as recited in claim 1, wherein said bottom floor is generally linear.

11. The condiment container as recited in claim 1, wherein said containers are configured so that more than one condiment container can be carried in a standard drink container at one time.

12. The condiment container as recited in claim 1, wherein the deep end of the container is wider than the shallow end of the container.

13. The condiment container as recited in claim 1, wherein the shallow end of the container is narrower than the deep end of the container.

14. A container for carrying various condiments, comprising:

a continuous sidewall, a peripheral shoulder portion extending outwardly from the continuous sidewall;

an open end formed by the peripheral shoulder portion;

a closed end forming a bottom floor;

a removable cover over the open end, the removable cover attached to the peripheral shoulder portion;

the container forming a wide end and a narrow end;

the removable cover is peelable from the wide end of the container;

the cover totally removable from the wide end of the container to access the wide end of the container; and, the cover removable from the narrow end to squirt or squeeze a condiment from the container.

15. The condiment container as recited in claim 14, wherein the wide end of the container is deeper than the narrow end of the container.

16. The condiment container as recited in claim 14, wherein the narrow end of the container is shallower than the wide end of the container.

17. The condiment container as recited in claim 14, wherein the cover is secured to the peripheral shoulder portion with an adhesive.

18. A container for carrying various condiments, comprising:

a continuous sidewall, a peripheral shoulder portion extending outwardly from the continuous sidewall;

an open end formed by the peripheral shoulder portion;

a closed end forming a bottom floor;

a removable cover over the open end, the removable cover attached to the peripheral shoulder portion via an adhesive the container forming a first end and a second end, the first end having a deep and wide construction, the second end having a shallow and narrow construction, wherein the removable cover is peelable from the first end;

the cover totally removable to access the first end of the container to dip a food item into the first end; and, the cover removable from the second end to squirt or squeeze a condiment from the container.

19. The condiment container as recited in claim 1, wherein said condiment container provides a dual function condiment container to dip a food item into the deep end of the container and to squirt a condiment from the shallow end of the container.

* * * * *